US006094175A

United States Patent [19]

Alessi et al.

[11] Patent Number: 6,094,175

[45] Date of Patent: Jul. 25, 2000

[54] OMNI DIRECTIONAL ANTENNA

[75] Inventors: Frank J. Alessi, Los Angeles; Cynthia A. Dixon, Rancho Palos Verdes; Parthasarathy Ramanujam, Redondo Beach; Mon N. Wong, Torrance, all of Calif.

[73] Assignee: Hughes Electronics Corporation, El Segundo, Calif.

[21] Appl. No.: 09/193,237

[22] Filed: Nov. 17, 1998

[51] Int. Cl.[7] ..... H01Q 13/00

[52] U.S. Cl. ..... 343/786; 333/21 A

[58] Field of Search ..... 343/771, 786, 343/782, 840, 781 R, 781 P, 781 CA, 772, 775; 333/117, 135, 137, 21 A, 157, 159

[56] References Cited

U.S. PATENT DOCUMENTS

| | | | |
|---|---|---|---|
| 3,332,083 | 7/1967 | Broussaud | 343/786 |
| 3,949,404 | 4/1976 | Fletcher et al. | 343/761 |
| 4,498,062 | 2/1985 | Massaglia | 333/135 |
| 4,538,175 | 8/1985 | Balbes et al. | 343/786 |
| 5,066,959 | 11/1991 | Huder | 343/786 |
| 5,576,668 | 11/1996 | Clark et al. | 333/21 A |

*Primary Examiner*—Tan Ho

*Attorney, Agent, or Firm*—T. Gudmestad; M. W. Sales

[57] ABSTRACT

A dual band omni directional antenna is disclosed. A dielectric cylinder supports a cone shaped reflector over a corrugated radio frequency horn. Orthogonal mode transducers produce and conduct circularly polarized radio frequency waves within the horn. The reflector, the horn, and the transducers are all coaxially disposed. The antenna produces a torodial radiation pattern in a plane that is substantially orthogonal to the axis of the antenna. Transmit and receive functions may be performed simultaneously using a single reflector and two orthogonal mode transducers.

12 Claims, 3 Drawing Sheets

OMNI DIRECTIONAL ANTENNA

BACKGROUND OF THE INVENTION (a) Field of the Invention

The present invention relates generally to omni directional antennas. More particularly, it relates to an omni directional antenna having a shaped reflector.

(b) Description of Related Art

Bicone antennas are commonly used to produce omni directional radio frequency radiation patterns. An omni directional radiation pattern provides a wide angle of coverage, which is especially advantageous in mobile communications applications. A single bicone antenna generally comprises a waveguide, two feedprobes, three polarizing pins, a plurality of radiating slots, and two reflectors. Typically, an electrical radio frequency input is applied to one of the feedprobes, and the other feedprobe is loaded with a termination or connected to another channel for redundant operation. The feedprobes are coplanar and are spaced 90° apart along the wall of the waveguide.

The energized feedprobe produces linearly polarized waves, within the waveguide, that are converted into circularly polarized waves by the polarizing pins. These circularly polarized waves form a standing wave between the reflectors that excites a series of longitudinal or transverse slots in the waveguide to radiate linearly polarized waves.

This conventional omni directional antenna design has several drawbacks. For example, an expensive, bulky polarizer shield is needed to prevent multipathing effects due to leakage through the walls of the waveguide. In addition, assembly and material costs are high because two reflectors must be precisely mounted to the waveguide.

These disadvantages become even more apparent for applications that require a dual-band antenna. Historically, a dual bicone antenna is used for dual-band applications. Essentially, a dual bicone antenna consists of two single bicone antennas joined to a common waveguide.

SUMMARY OF THE INVENTION

In accordance with one aspect of the present invention, an omni directional antenna includes a radio frequency energy conduit, a shaped reflector, a dielectric structure for supporting the reflector at a predetermined distance and in a predetermined coaxial orientation over an aperture of the horn, and an orthogonal mode transducer for producing and conducting radio frequency waves within the conduit.

The radio frequency energy conduit is preferably a slow waveguide structure, such as a corrugated horn, that directs radio frequency waves along the axis of the antenna between the orthogonal mode transducer and the shaped reflector. The reflector is approximately cone-shaped and has a reflective surface, facing an upper aperture of the horn, that efficiently reflects radio frequency waves. The reflector is optimally contoured so that radio waves impinging on its reflective surface produce a substantially toroidal radiation pattern that coaxially surrounds the antenna.

The dielectric support structure is preferably a thin-walled cylinder made from a plastic or similar material that is highly transparent to radio frequency waves. The dielectric cylinder is specifically dimensioned so that the apex of the reflector is at an optimal distance from the upper aperture of the horn for a selected operational bandwidth. The orthogonal mode transducer is specifically adapted to produce and conduct a selected band of circularly polarized radio frequency waves within the horn.

Thus, the antenna can produce or receive radio frequency waves along trajectories that are substantially orthogonal to the axis of the antenna and which comprise a toroidal radiation pattern that coaxially surrounds it.

In accordance with another aspect of the present invention, an omni directional antenna comprises a radio frequency energy conduit, a shaped reflector, a dielectric structure for supporting the reflector at a predetermined distance and in a predetermined coaxial orientation over an aperture of the horn, and a low frequency orthogonal mode transducer and a high frequency orthogonal mode transducer for producing and conducting radio frequency waves within the conduit.

The radio frequency energy conduit is preferably a slow waveguide structure, such as a corrugated horn, that directs radio frequency waves along the axis of the antenna between the orthogonal mode transducer and the shaped reflector. The reflector is approximately cone-shaped and has a reflective surface, facing an upper aperture of the horn, that efficiently reflects radio frequency waves. The reflector is optimally contoured so that radio waves impinging on its reflective surface produce a substantially toroidal radiation pattern that coaxially surrounds the antenna.

The dielectric support structure is preferably a thin-walled cylinder made from a plastic or similar material that is highly transparent to radio frequency waves. The dielectric cylinder is specifically dimensioned so that the apex of the reflector is at an optimal distance from the upper aperture of the horn for a selected operational bandwidth. The orthogonal mode transducers are specifically adapted to produce and conduct selected bands of circularly polarized radio frequency waves within the horn.

Thus, the antenna can simultaneously produce and receive radio frequency waves along trajectories that are substantially orthogonal to the axis of the antenna and which comprise a toroidal radiation pattern that coaxially surrounds it.

The invention itself, together with further objects and attendant advantages, will best be understood by reference to the following detailed description, taken in conjunction with the accompanying drawings.

DESCRIPTION OF THE PREFERRED EMBODIMENTS

Figure 1:
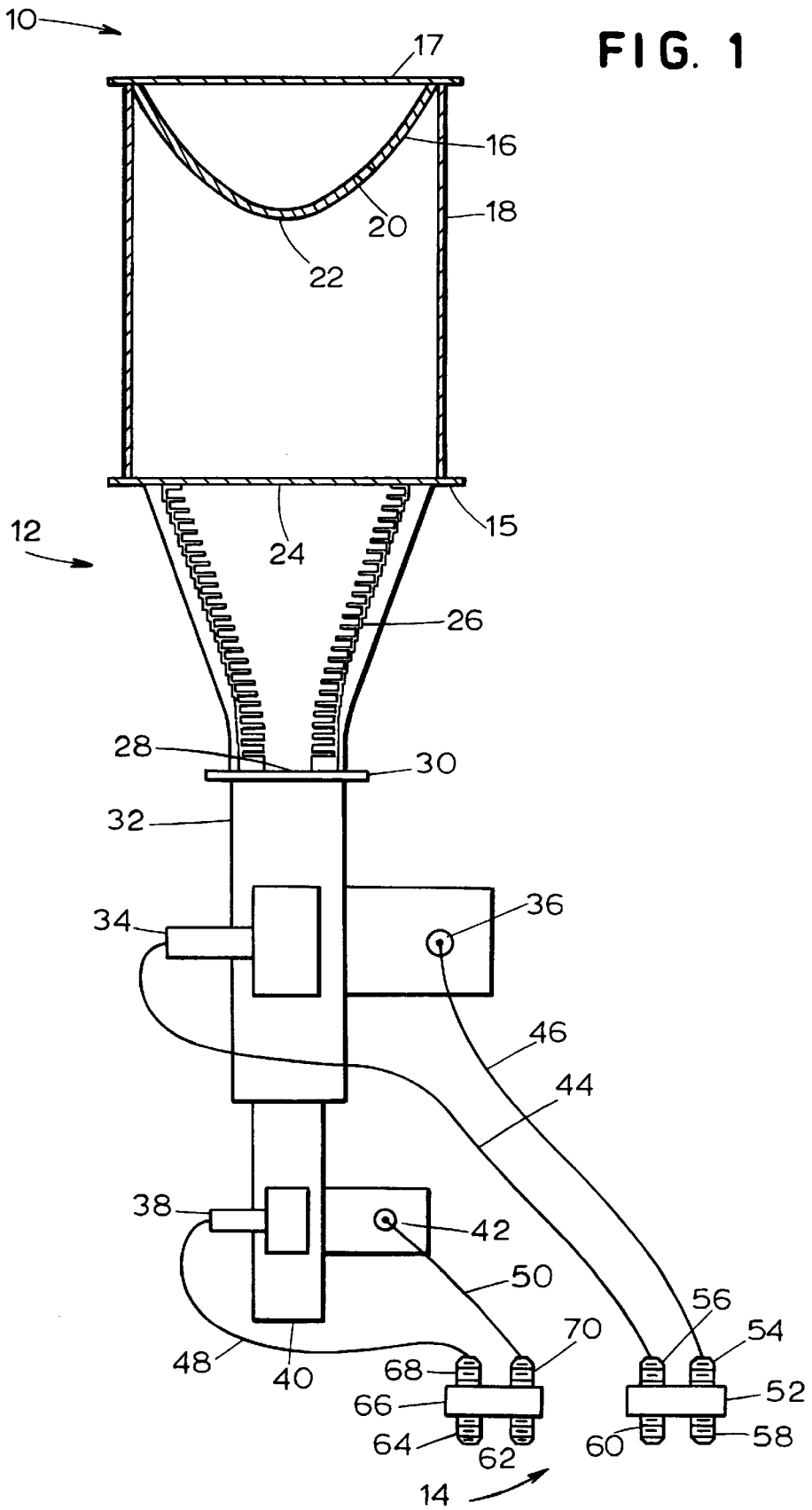
FIG. 1 is a partially sectioned view of an antenna system embodying the present invention.

The present invention is embodied in a dual band omni directional antenna system 10 illustrated in FIG. 1. The antenna system 10 includes an antenna 12 and a signal conditioning sub-system 14. The antenna 12 includes a shaped reflector 16, a dielectric cylinder 18, a dielectric cap 17, a dielectric base 15, a corrugated horn 26, a mating flange 30, a low frequency band orthogonal mode transducer 32, and a high frequency band orthogonal mode transducer 40, all of which are coaxially disposed as shown in FIG. 1. The signal conditioning sub-system 14 further includes a low frequency power splitter 52 and a high frequency power splitter 66.

It is well known that, for practical antenna designs, antenna dimensions are critically related to the wavelength of the signals transmitted and received. The wavelengths transmitted and received are typically a significant portion of the antenna's overall dimensions, and antenna performance may change dramatically as particular dimensions approach some integer multiple or fraction of the transmitted or received wavelengths.

Various components of the antenna 12 are optimally dimensioned and configured for a predetermined nominal frequency or wavelength that lies within the desired operational bandwidth of the antenna. For example, the embodiment in FIG. 1 has been dimensioned and configured for a nominal frequency of approximately 14.5 GHz and a broadband operational frequency range of 11.7 GHz to 17.8 GHz.

Accordingly, the cylinder 18 has a diameter of 5" and an overall height of 6.5", the reflector 16 has a diameter of approximately 5" and a height of 2.5", and the corrugated horn 26 has a height of 5" and an upper aperture diameter of approximately 3". These overall dimensions are approximate and may be more precisely determined (through numerical or empirical analysis) to achieve a desired level of performance for a given operational bandwidth.

The dielectric cylinder 18 is coaxially disposed adjacent to an upper aperture 24 of the corrugated horn 26. The cylinder 18 supports the reflector 16 at a predetermined distance from the upper aperture 24. The dielectric cap 17 is attached to the upper end of the cylinder 18. The cap 17 may additionally provide a rigid mounting surface for the reflector 16. The dielectric base 15 attaches to the lower end of the cylinder 18. The cap 17 and the base 15 provide additional structural integrity to the cylinder 18 without attenuating radio frequency waves traveling through the antenna 12.

The cylinder 18, the cap 17, and the base 15 are all ideally made from a dielectric material that is highly transparent to radio frequency energy or waves. A variety of plastics may be suitable for this purpose. A suitable dielectric material is sold under the trade name ULTEM 2000. For example, a cylinder made from ULTEM 2000 plastic that has a wall thickness of approximately 0.010 will allow radio frequency waves to pass through it substantially unattenuated.

Although the preferred embodiment shows that the reflector 16 is supported over the horn 26 by a cylindrical structure 18 having a cap 17 and a base 15 all made from a dielectric material that is substantially transparent to radio waves, other supporting structures may be used to achieve a similar result. For example, a thin-walled dielectric rectangular channel, or a plurality of thin dielectric bars may be substituted for the cylinder 18. In any case, the supporting structure must support the reflector 16 in a predetermined position above the horn 26, and must have a substantially negligible effect on the radiation pattern of the antenna 12.

The reflector 16 is a cone-shaped structure that has a radio frequency reflective surface 20 and an apex 22 that face the corrugated horn's upper aperture 24. The reflector 16 has a predetermined contour that produces a desired omni directional radiation pattern in response to radio frequency waves impinging on its reflective surface 20. The preferred reflector contour produces a torroidal or doughnut shaped radiation pattern that extends concentrically from the dielectric cylinder 18. Thus, with the preferred reflector contour, the radiation pattern is strongest along trajectories that are orthogonal to the axis of the antenna 12, decreases as the elevation angle deviates away from the orthogonal trajectory, and is circumferentially uniform for a given elevation angle.

The reflector's contour may be precisely determined using a variety of iterative numerical techniques that work to build an optimal contour in discrete sections. Such iterative techniques may be easily derived by one of ordinary skill in the art. This piecewise construction of an optimal reflector contour generally produces a better result than that produced using a simpler, more restrictive closed form solution because the only optimization constraints imposed by the iterative numerical technique are given by the desired radiation pattern. Alternatively, the reflector's contour may be determined empirically to produce a desired radiation pattern. In any case, the final reflector contour ideally produces a uniform omni directional toroidal radiation pattern that extends concentrically from the cylinder 18 in a plane that is substantially orthogonal to the axis of the antenna 12.

The reflector 16 is ideally made from a material that efficiently reflects radio frequency waves. For example, the reflector 16 may be a solid aluminum structure and the reflective surface 20 may be formed by directly finishing or polishing the aluminum structure. Alternatively, the reflector may be comprised of a dielectric form having a desired contour that is covered with a thin reflective metallic shell or metalized surface.

The apex 22 of the reflector 16 is precisely distanced from the horn's upper aperature 24 to further optimize the pattern and uniformity of reflected radio frequency waves. In the present example, the apex 22 of the reflector 16 is approximately 4" from the upper aperature 24. A more precise location of the apex 22 may be determined using commonly known numerical or empirical techniques.

The corrugated horn 26 is sandwiched between the dielectric cylinder 18 and a mating flange 30. Those skilled in the art will immediately recognize that the corrugated horn 26 functions as a slow waveguide structure. Slow waveguide structures are a well-known method of increasing the useful bandwidth of a radio frequency energy conduit.

Radio frequency waves entering a lower aperture 28 of the horn 26 may include multiple modes or harmonics of a fundamental frequency or wavelength. Circumferential slots along the inside wall of the horn work to slow higher order harmonics so that they add constructively with the fundamental frequency. A variety of slot patterns (corrugation patterns) may be selected to achieve a particular frequency response characteristic. For example, in the present embodiment, a slot pattern is shown which graduates the slot width from 0.5 $\lambda$ to 0.25 $\lambda$ ($\lambda$=fundamental wavelength) over the first seven slots from the horn's lower aperture 28.

In addition, the horn's profile may be selected to achieve a particular cost or performance objective. For the present embodiment, the horn has been specially profiled using an interative numerical technique, however, a simple linear taper may be used without seriously imparing the resulting antenna characteristics.

Thus, the present invention may be embodied within antennas employing a variety of horn designs to achieve a particular design objective. For example, a linearly tapered (profiled) corrugated horn generally provides good broadband performance at a reasonble cost. A Potter horn provides good narrowband performance at a low cost, and a standard conical horn provides the lowest cost but sacrifices performance (e.g. multipathing due to radio frequency energy leakage through the walls of the horn). The horn 26 is preferably made from aluminum, but may be made from a variety of other metals or metal covered dielectric forms.

The low frequency band orthogonal mode transducer 32 adapts to the corrugated horn's lower aperture 28 through the mating flange 30. Orthogonal mode transducers are commonly used to launch, conduct, and combine orthogonal, linearly polarized radio frequency waves into circularly polarized waves. The low frequency band transducer 32 has a first signal port 34 and a second signal port 36. In the present embodiment, these ports are configured to accept a standard sub-minature adapter (SMA) coax connector, however, any suitable radio frequency connector could be substituted. The transducer 32 is coaxially disposed so that the circularly polarized radio frequency waves that it conducts are directed along the antenna's axis.

The orthogonal mode transducer 32 is preferably selected for use at a telemetry (transmit) frequency. For example, a WR-75 orthogonal mode transducer may be used which efficiently produces, conducts, and receives circularly polarized radio waves having a nominal frequency of 11.7 GHz.

The high frequency orthogonal mode transducer 40 is adapted to the low frequency orthogonal mode transducer 32, and is coaxially disposed so that the circularly polarized radio frequency energy that it conducts is directed along the axis of the antenna 12. The high frequency orthogonal mode transducer 40 has a first signal port 38 and a second signal port 42. In the present embodiment, these ports are configured to accept a standard sub-minature adapter (SMA) coax connector, however, any suitable radio frequency connector may be substituted.

The orthogonal mode transducer 40 is preferably dimensioned for use at a command (receive) frequency. For example, a WR-62 orthogonal mode transducer may be used which efficiently produces, conducts, and receives circularly polarized radio waves having a nominal frequency of 17.3 GHz.

Figure 2:
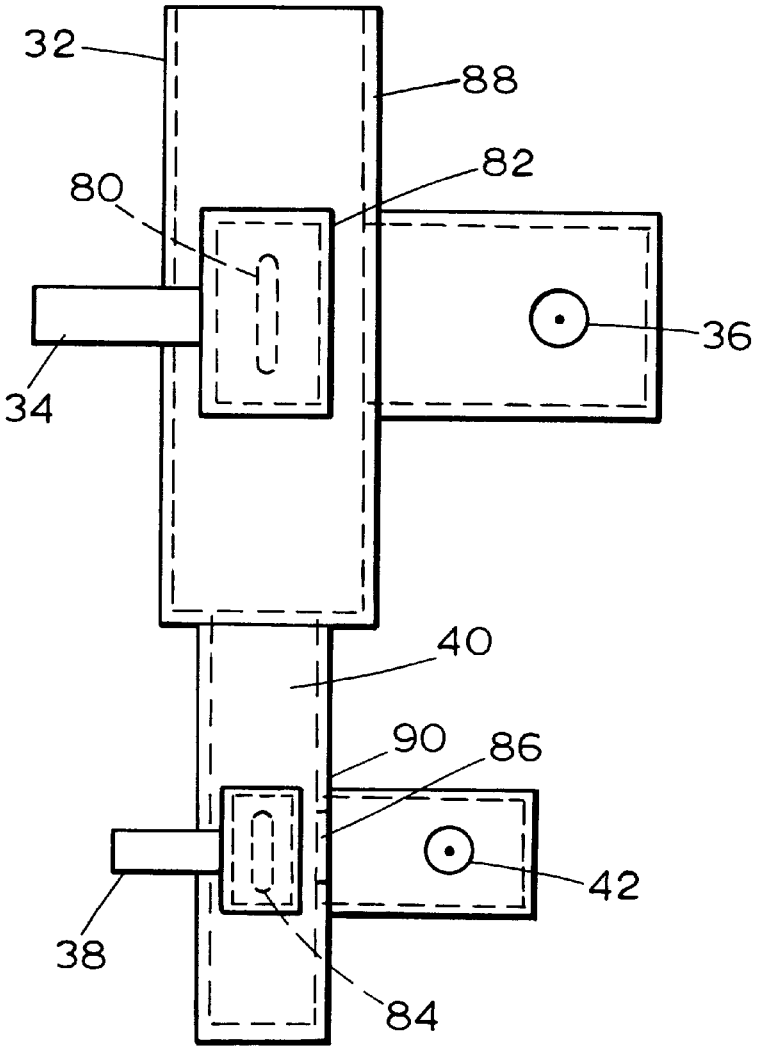
FIG. 2 is a detailed front view of the orthogonal mode transducers shown in FIG. 1.
Figure 3:
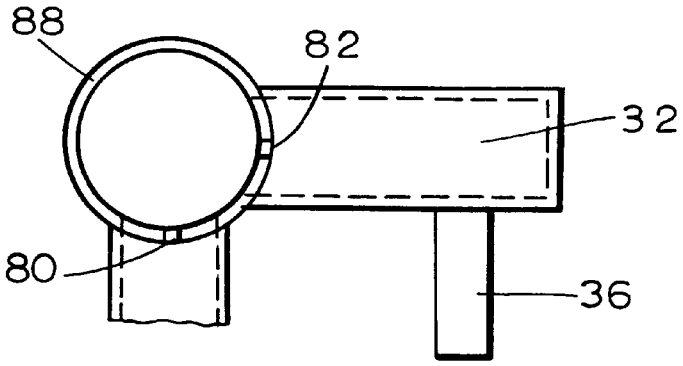
FIG. 3 is a detailed top view of the orthogonal mode transducers shown in FIG. 1.
Figure 4:
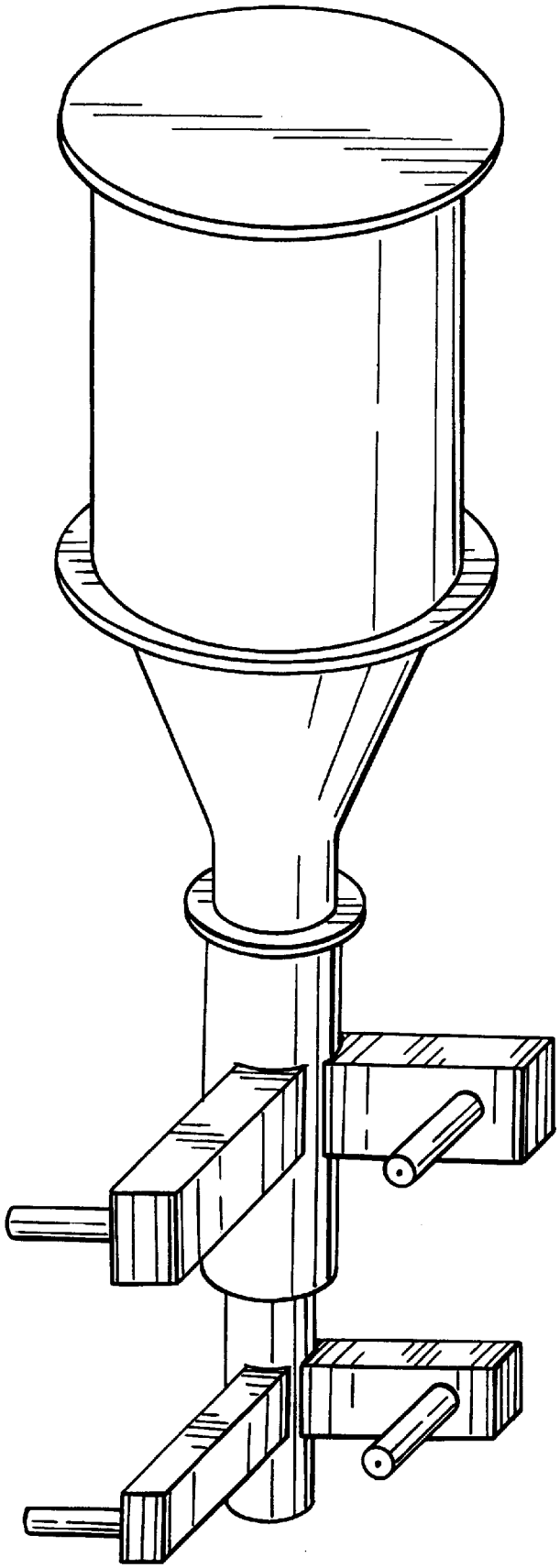
FIG. 4 is a perspective view of the antenna system shown in FIG. 1, and embodying aspects of the present invention.

Illustrated in FIG. 2 and FIG. 3 are more detailed views of the transducers 32 and 40. Elements appearing in FIG. 2 and FIG. 3 that also appear in FIG. 1 are given reference numbers identical to those associated with the elements in FIG. 1. As shown in FIG. 2, the transducers 32 and 40 may further include resonant shunt slots 80, 82, 84, and 86 that extend through the waveguide walls 88 and 90. The slots 80, 82, 84, and 86 are preferably oblong openings that have a length approximately equal to one-half the wavelength of the nominal operating frequency of the associated transducer. The slots are aligned so that their lengths are substantially parallel to the length of the waveguide walls 88 and 90.

The low frequency transducer 32 has two shunt slots 80 and 82 that are specifically dimensioned to prevent the ingress of higher frequency radiation that could interfere with the conduction of lower frequency signals. The first and second signal ports 34 and 36 have associated first and second shunt slots 80 and 82 respectively. The slots 80 and 82 are dimensioned such that radio waves with a frequency substantially higher than the nominal operating frequency of the transducer 32 are significantly attenuated when they pass through the slot openings. The use of a slot feature to filter or reject radio waves is well known in the art.

Similarly, the high frequency transducer 40 has two shunt slots 84 and 86 that are specifically dimensioned to prevent the ingress of higher frequency radiation that could interfere with the conduction of lower frequency signals. The first and second signal ports 38 and 42 have associated first and second shunt slots 84 and 86 respectively. The slots 84 and 86 are dimensioned such that radio waves with a frequency substantially higher than the nominal operating frequency of the transducer 40 are significantly attenuated when they pass through the slot openings.

The power splitters 52 and 66 are commonly known as −3 dB Hybrids. These hybrids split a single input signal into a pair of quadrature signals that each include half of the original input power. The low frequency hybrid 52 has a first signal port 60, a second signal port 58, a third signal port 56, and a fourth signal port 54. The third signal port 56 of the low frequency hybrid 52 connects to the first signal port 34 of the low frequency transducer 32 via a first coaxial cable 44. The fourth signal port 54 of the low frequency hybrid 52 connects to the second signal port 36 of the low frequency transducer 32 via a second coaxial cable 46. The first and second coaxial cables 44 and 46 are substantially equal in length so that any delay or phase shift imparted by the cables to radio frequency signals traveling through them will be substantially balanced.

Similarly, the high frequency hybrid 66 has a first signal port 64, a second signal port 62, a third signal port 68, and a fourth signal port 70. The third signal port 68 of the high frequency hybrid 66 connects to the first signal port 38 of the high frequency transducer 40 via a third coaxial cable 48. The fourth signal port 70 of the high frequency hybrid 66 connects to the second signal port 42 of the high frequency transducer 40 via a fourth coaxial cable 50. The third and fourth coaxial cables 48, 50 are substantially equal in length so that any delay or phase shift imparted by the cables to radio frequency signals traveling through them will be substantially balanced.

In operation, a modulated electrical signal having a nominal frequency of 11.7 GHz is applied to either the first or second signal ports 60 and 58 of the low frequency hybrid 52. If the first port 60 is used, then the second port 58 is typically loaded with a termination to prevent the coupling of stray radio frequency signals. If the second port 58 is used, then the first port 60 is loaded with a termination. If the modulated 11.7 GHz signal is applied to the first port 60 of the low frequency hybrid 52 then a pair of half-power signals (containing information identical to the modulated input signal) appear at the third and fourth ports 56 and 54. The signal at the third port 56 is in-phase with respect to the input signal that is applied to the first port 60. The signal at the fourth signal port 54 phase lags by 90° the signal at the third port 56. Thus, the modulated 11.7 GHz input signal has been spilt into an identical pair of quadrature signals that each include half of the power of the original input signal.

The quadrature signals travel along the first and second coaxial cables 44 and 46 to the first and second signal ports 34 and 36 of the low frequency orthogonal mode transducer 32. The quadrature signals applied to the signal ports of the orthogonal mode transducer 32 are launched into free space as an orthongonal pair of linearly polarized waves. These orthogonal waves combine inside the transducer to form left hand circularly polarized (LHCP) telemetry waves that are directed along the axis of the antenna 12 towards the horn's input aperture 28.

Alternatively, applying the modulated 11.7 GHz signal to the second signal port 58 and terminating the first signal port 60 produces a pair of quadrature signals as outlined above, but results in right hand circularly polarized (RHCP) waves directed along the axis of the antenna 12. Furthermore, because the signal ports 54, 56, 58, and 60 of the low frequency hybrid 52 are electrically isolated two independently modulated 11.7 GHz electrical signals may be simultaneously applied to the first and second ports 60 and 58 so that one signal produces LHCP waves and the other produces RHCP waves that can be independently launched towards the horn's input aperture.

The circularly polarized telemetry waves produced by the low frequency transducer 32 travel through the horn's lower aperture 28 and continue through the body of the horn 26. The circularly polarized telemetry waves pass through the horn 26 substantially coherent and exit the horn at its upper aperture 24. The telemetry waves impinge on the reflective surface 20 of the the reflector 16 and are reflected along trajectories that are substantially orthogonal to the axis of the antenna 12, and that are consistent with the preferred toroidal radiation pattern.

It is well-known in the art that antennas are inherently reciprocal devices. Thus, the transmission and reception characteristics for a given antenna are substantially identical. Accordingly, the antenna 12 is responsive to incoming command frequency waves in a manner that is analogous to its transmission of telemetry waves (described above).

Circularly polarize command waves impinging on the reflective surface 20 of the reflector 16 along a trajectory that is substantially orthogonal to the axis of the antenna 12 are reflected along the axis of the antenna towards the upper aperture 24 of the horn 26.

The command frequency waves travel through the horn and exit the horn's lower aperture 28 substantially coherent. The command frequency waves bypass the low frequency transducer 32 and are caught by the high frequency transducer 40. The high frequency transducer 40 decomposes circularly polarized command waves, with a nominal frequency of 17.3 GHz, into orthogonal, linearly polarized waves. These linearly polarized waves are converted into quadrature electrical signals on the first and second signal ports 38 and 42 of the high frequency transducer 40.

The quadrature signals travel through the third and fourth coaxial cables 48 and 40 and are applied to the third and fourth signal ports 68 and 70 of the high frequency hybrid 66. The hybrid 66 combines the quadrature signals into a single higher powered signal on the first or second signal ports 64 and 62.

Mutual interference between the high frequency transducer 32 and the low frequency transducer 40 is minimal. The high frequency transducer 40 is dimensioned optimally for command (receive) frequency waves and inherently rejects the longer telemetry wavelengths produced by the low frequency transducer 32. Also, the low frequency transducer 32 includes a resonant shunt slot that works to block the ingress of unwanted higher frequency command waves. Thus, this mutual isolation between the frequency bands of the transducers 32 and 40 allows the antenna system 10 to be used for the simultaneous transmission and reception of radio frequency waves.

Of course, it should be understood that a range of changes and modifications can be made to the preferred embodiment described above. For example, the transmit and receive frequency bands could easily be reversed so that the high frequency transducer 40 is used for telemetry (transmit) and the low frequency transducer 32 is used for command (receive). Additionally, the antenna system 10 could be simplified for single band operation in a transmit or receive only mode. It is therefore intended that the foregoing detailed description be regarded as illustrative rather than limiting and that it be understood that it is the following claims, including all equivalents, which are intended to define the scope of this invention.

What is claimed is:

1. An omni directional antenna comprising:

a radio frequency energy conduit;

a shaped reflector having a reflective surface that faces said radio frequency energy conduit;

said shaped reflector adapted to reflect radio frequency waves on trajectories orthogonal to the axis of the energy conduit;

a dielectric structure supporting said reflector at a predetermined distance from said radio frequency energy conduit so that the reflector and the conduit are coaxially disposed;

an orthogonal mode transducer adapted to produce and conduct circularly polarized radio frequency waves within said radio frequency energy conduit.

2. The antenna of claim 1, wherein the energy conduit comprises a radio frequency horn.

3. The antenna of claim 1, wherein the energy conduit comprises a corrugated horn.

4. The antenna of claim 1, wherein the reflector is cone-shaped.

5. The antenna of claim 4, wherein the reflector comprises a reflective metal surface.

6. The antenna of claim 1, wherein the orthogonal mode transducer is further adapted for use at a telemetry or command frequency.

7. The antenna of claim 1 further comprising a second orthogonal mode transducer adapted to produce and conduct circularly polarized radio frequency waves within the energy conduit.

8. The antenna of claim 7, wherein the first orthogonal mode transducer is adapted to a telemetry frequency and the second orthogonal mode transducer is adapted to a command frequency.

9. The antenna of claim 7, wherein the energy conduit comprises a radio frequency horn.

10. The antenna of claim 7, wherein the energy conduit comprises a corrugated horn.

11. The antenna of claim 7, wherein the reflector comprises a cone shape.

12. The antenna of claim 11, wherein the reflector comprises a reflective metal surface.

* * * * *